US011504843B2

(12) United States Patent
Cacciabeve

(10) Patent No.: US 11,504,843 B2
(45) Date of Patent: Nov. 22, 2022

(54) FLEXIBLE MAGNETIC SOCKET HOLDER

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 42 days.

(21) Appl. No.: 17/237,414

(22) Filed: Apr. 22, 2021

(65) Prior Publication Data

US 2022/0339775 A1 Oct. 27, 2022

(51) Int. Cl.

| | |
|---|---|
| ***B25H 3/00*** | (2006.01) |
| ***B25B 13/56*** | (2006.01) |
| ***B25B 13/06*** | (2006.01) |

(52) U.S. Cl.

CPC ..... *B25H 3/003* (2013.01); *B25B 13/56* (2013.01); *B25B 13/06* (2013.01)

(58) Field of Classification Search

CPC .. B25H 3/003; B25H 3/04; B25H 3/00; B25B 13/06

USPC ..... 206/379, 350, 373, 378

See application file for complete search history.

(56) References Cited

U.S. PATENT DOCUMENTS 3,405,377 A * 10/1968 Pierce ..... B25H 3/003 206/378
4,337,860 A * 7/1982 Carrigan ..... B25H 3/003 211/49.1
4,405,108 A * 9/1983 Muirhead ..... A47F 5/0823 211/DIG. 1
4,508,221 A * 4/1985 Olson ..... B25F 5/029 206/478
5,080,230 A * 1/1992 Winnard ..... B25H 3/06 211/DIG. 1

(Continued)

FOREIGN PATENT DOCUMENTS

CN 206236502 U 6/2017

OTHER PUBLICATIONS

Magnetic Strips (With Permanent Pegs), Triton Products, www.tritonproducts.com, Sep. 24, 2020.

(Continued)

*Primary Examiner* — Anthony D Stashick
*Assistant Examiner* — Prince Pal
(74) *Attorney, Agent, or Firm* — Breiner & Breiner, L.L.C.

(57) ABSTRACT

A flexible magnetic socket holder is disclosed having a flexible elongated strip having a top wall, a bottom wall, a first side wall and a second side wall. The top wall has a plurality of posts each adapted to receive a socket and having an opening on each side of the posts for exposing a magnet. The bottom wall has a retaining member extending downwardly from the bottom wall and adapted to receive the magnet. The first side wall and the retaining member have an opening adapted to receive the magnet and retain the magnet by friction fit. The second side wall is adapted to retain the magnet in the retaining member. The magnet is inserted in the retaining member through the opening in the first side wall and the retaining member. The top wall of the flexible elongated strip is adapted to magnetically hold the sockets at each post and the bottom wall of the flexible elongated strip is adapted to magnetically attach to different shaped ferrous surfaces.

20 Claims, 5 Drawing Sheets

(56) References Cited

U.S. PATENT DOCUMENTS 5,188,242 A * 2/1993 Smith ..... B25F 5/029 248/205.3
5,228,570 A * 7/1993 Robinson ..... B25B 13/56 81/177.85
5,456,359 A * 10/1995 Horn ..... B25H 3/06 211/DIG. 1
5,560,480 A * 10/1996 Singleton ..... B65D 25/101 206/378
5,660,276 A * 8/1997 Winnard ..... B25H 3/028 211/DIG. 1
5,669,516 A * 9/1997 Horn ..... B25H 3/06 211/DIG. 1
5,743,394 A * 4/1998 Martin ..... B25H 3/003 211/DIG. 1
5,855,285 A * 1/1999 Laird ..... B25H 3/003 206/378
6,006,630 A 12/1999 Vasichek et al.
6,006,906 A * 12/1999 Winnard ..... B25H 3/06 206/376
6,168,018 B1 * 1/2001 Ramsey ..... B25H 3/06 206/378
6,702,112 B1 * 3/2004 Henderson ..... B65D 85/20 224/904
6,719,155 B1 * 4/2004 Chang ..... B25H 3/04 211/DIG. 1
6,761,095 B2 * 7/2004 Beauchamp ..... B25F 5/029 81/177.4
6,923,317 B2 8/2005 Coleman, Jr. et al.
6,964,545 B1 * 11/2005 Languasco ..... B25F 5/029 362/120
7,735,645 B2 * 6/2010 Joyce ..... B25H 3/04 211/DIG. 1
7,905,354 B1 * 3/2011 Geibel ..... B25H 3/06 206/378
8,066,268 B2 * 11/2011 Brauer ..... B25F 5/029 269/130
8,181,780 B1 * 5/2012 Guffey ..... B25H 3/06 206/378
8,272,628 B2 * 9/2012 Winnard ..... B25H 3/06 269/6
D737,487 S 8/2015 Beckett et al.
9,243,745 B1 * 1/2016 Hughes ..... B25H 3/04
9,701,008 B2 * 7/2017 Cho ..... B25F 5/029
10,207,401 B1 * 2/2019 Pedrin ..... B25H 3/003
2003/0079581 A1 * 5/2003 Beauchamp ..... B25F 5/029 81/490
2004/0055917 A1 * 3/2004 Stern ..... B25H 3/003 206/373
2004/0238466 A1 * 12/2004 Shiao ..... B25H 3/04 211/DIG. 1
2007/0059114 A1 * 3/2007 Grimes, II ..... B25F 5/029 224/183
2009/0152150 A1 * 6/2009 Kernodle, Jr. ..... B25H 3/003 206/379
2015/0122750 A1 * 5/2015 Kao ..... F16M 13/022 211/13.1
2016/0031074 A1 * 2/2016 Su ..... B25H 3/04 206/349
2016/0167219 A1 * 6/2016 Cho ..... A45F 5/02 224/666
2016/0243695 A1 * 8/2016 Billups, Jr. ..... B25H 3/003
2017/0282352 A1 * 10/2017 Brull ..... B23Q 3/15706
2017/0314769 A1 11/2017 Cacciabeve
2018/0104812 A1 * 4/2018 Wacker ..... B25H 3/04
2018/0343991 A1 * 12/2018 Olson ..... B25H 3/003
2019/0015966 A1 * 1/2019 Nordness ..... B25H 3/003
2019/0070723 A1 * 3/2019 Billups, Jr. ..... B25H 3/003
2019/0084146 A1 * 3/2019 Boltryk ..... B25H 3/003
2019/0283233 A1 * 9/2019 Kukucka ..... B25H 3/06
2020/0055176 A1 * 2/2020 Curchod ..... B25B 21/007
2020/0094396 A1 * 3/2020 Steiner ..... B25H 3/003
2020/0122315 A1 * 4/2020 Hurley ..... B25H 3/003
2021/0039245 A1 * 2/2021 Kukucka ..... B25H 3/003
2021/0138626 A1 * 5/2021 Brull ..... B25G 1/08
2021/0237253 A1 * 8/2021 Moss ..... B25B 21/00
2022/0080576 A1 * 3/2022 Chen ..... B25H 3/003

OTHER PUBLICATIONS

Magclip, Red Plastic Socket Holder Strip, Manufacturer Model #72400, Grainger Industrial Supply, www.grainger.com, Jul. 2021.
Flexible ¼" DDR Drive Magnetic Socket Organizer Storage Strip Holder Tool, www.Ebay.com, (no brand), Aug. 13, 2021.
Two Photographs, Great Neck Portable Socket Holders, www.greatnecksaw.com.

* cited by examiner

FLEXIBLE MAGNETIC SOCKET HOLDER

FIELD OF THE INVENTION

The present invention relates to a socket holder. More particularly, the invention relates to a flexible magnetic socket holder wherein the magnets will hold the sockets on the holder and the magnets will also attach the holder to almost any shape ferrous surface.

BACKGROUND OF THE INVENTION

Socket wrenches and similar tools are used in numerous applications, including in automotive garages. Preferably, the different size sockets for a socket wrench should be maintained by size and for ease in use by a worker. The art is replete with different devices for holding sockets, including, for example, magnetic socket holders such as disclosed in U.S. Pat. No. 5,743,394.

These known devices have various shortcomings, including that the sockets may fall off of a socket holder and may not be used in tight workspaces. These and other shortcomings of these devices are addressed by the present invention.

SUMMARY OF THE INVENTION

The invention is directed to socket holder. The socket holder includes an elongated strip made of a flexible material such as a thermoplastic rubber (TPR) or silicone. There are a plurality of posts on the socket holder over which a socket is placed. The posts align the sockets in place but are not used to secure the sockets to the strip. Rather, there are series of magnets, one under each post, perpendicular to the axis of the elongated strip. The magnets are inserted from the side or bottom of the elongated strip thereby allowing for the sockets to magnetically grip the top of the flexible elongated strip and hold the sockets in place. The magnets are also preferably exposed from the underside of the elongated strip and allow the strip through the magnets to grip any shape/arc/angled ferrous surface.

Features and benefits of the invention include: the flexibility of the elongated strip with the magnets. The unique design of the socket holder allows a manufacturer to use the same mold to make a flexible version or a non-flexible version of the socket holder. Because each socket is held individually to the elongated strip by the magnet, the sockets will not peel off the strip. Each magnet is exposed at the top of the strip for engaging the socket and exposed at the bottom of the strip for attachment to another surface. Because the device is flexible, it may be attached to almost any ferrous surface, including a car wheel well, or over an arc, or over an angled shaped object. The individual posts may be made in a number of shapes, e.g. square, hex, X, round, S or the like.

The present invention is directed to a flexible magnetic socket holder comprising a flexible elongated strip having a top wall, a bottom wall, a first side wall and a second side wall. The top wall has a plurality of posts each adapted to receive a socket and having an opening on each side of the posts for exposing a magnet. The bottom wall has a retaining member extending downwardly from the bottom wall and adapted to receive the magnet. The first side wall and the retaining member have an opening adapted to receive the magnet and retain the magnet by friction fit. The second side wall is adapted to retain the magnet in the retaining member. The magnet is inserted in the retaining member through the opening in the first side wall and the retaining member. The top wall of the flexible elongated strip is adapted to magnetically hold the sockets at each post and the bottom wall of the flexible elongated strip is adapted to magnetically attach to different shaped ferrous surfaces.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings.

DETAILED DESCRIPTION OF THE PREFERRED EMBODIMENTS

Figure 1:
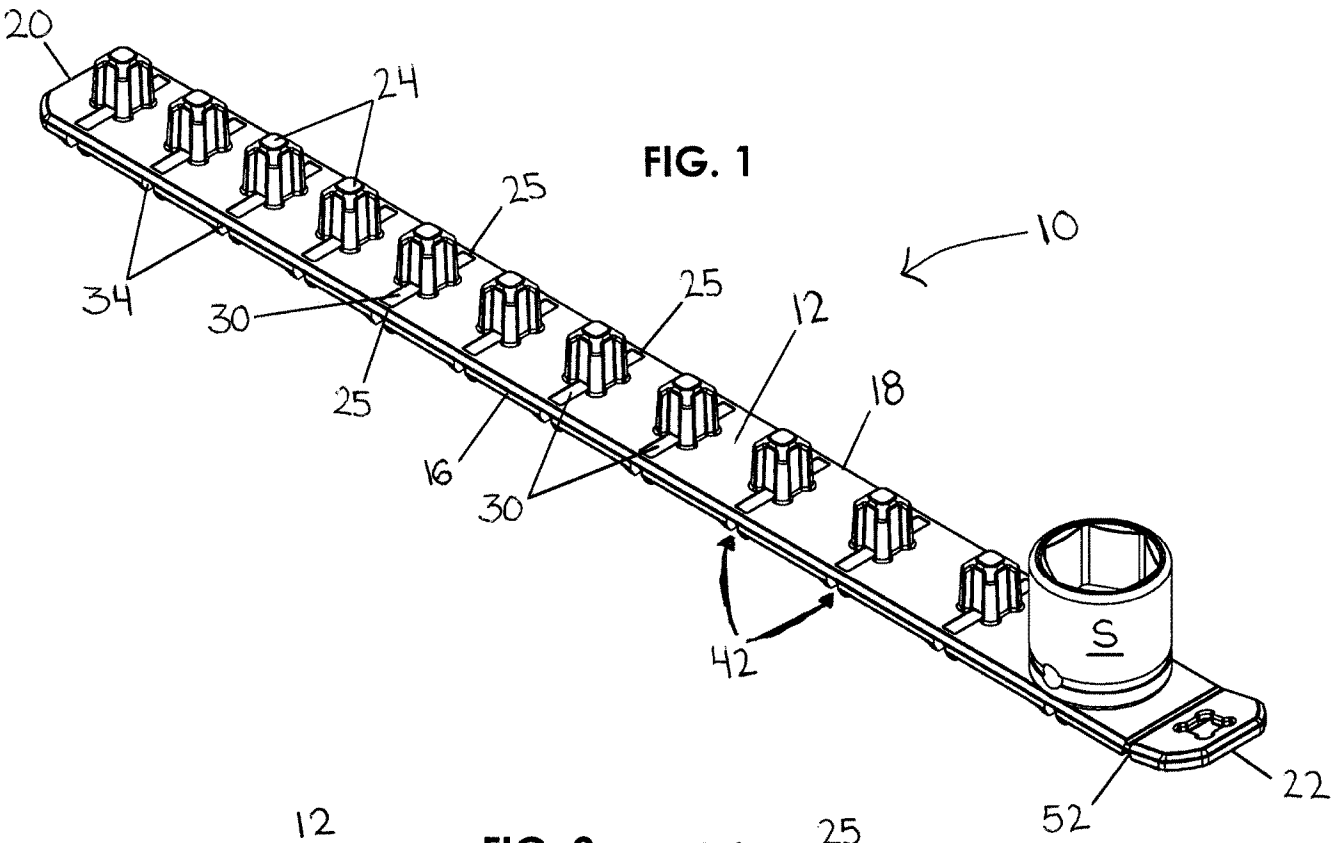
FIG. 1 is a perspective view of the flexible magnetic socket holder of the invention.
Figure 2:
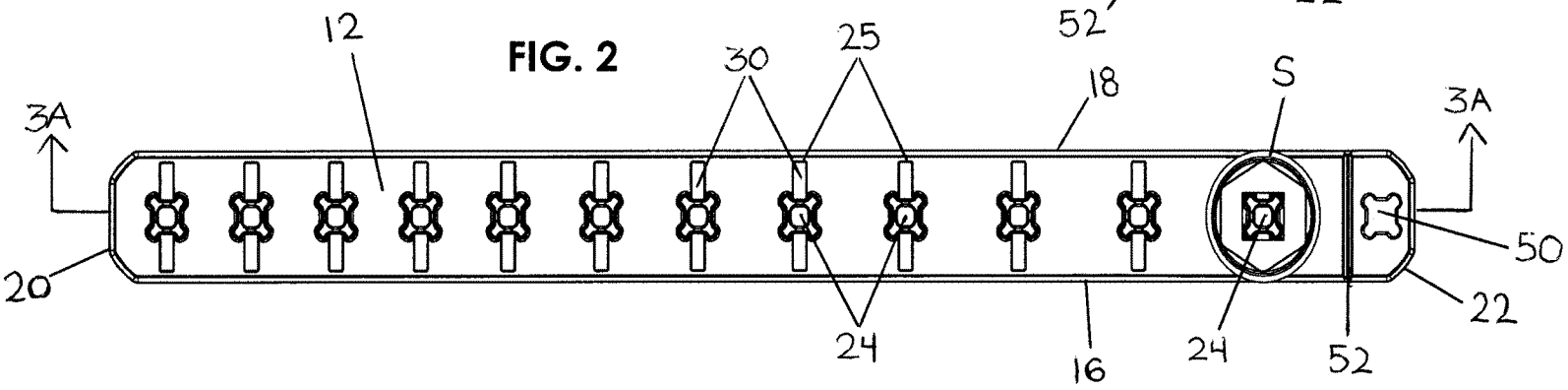
FIG. 2 is a top view of the socket holder of FIG. 1.

The invention is directed to a socket holder for holding sockets for socket wrenches or similar tools. The socket holder is made of a flexible material such as thermoplastic rubber (TPR) or silicone and having a structure such that the socket holder may flex for attachment of the socket holder to almost any shape article. The socket holder includes magnets which will hold the socket to the top of the socket holder and which magnets also allow the bottom of the socket holder to magnetically adhere to different shaped ferrous objects, e.g. an automobile wheel well, the underside of an automobile hood, a work area or any other article. The socket holder may be made of different sizes for holding different size sockets, e.g. a ¼ inch socket or a ⅜ inch socket. FIGS. 1-4 show a first embodiment of the socket holder for holding twelve different sockets in one column, and FIGS. 5-9 show a second embodiment of the socket holder holding two different types of sockets in two columns. The invention will be described in further detail below.

Referring to FIGS. 1-4, there is shown a socket holder 10 having a top wall 12, bottom wall 14, first side wall 16, second side wall 18, first end wall 20 and second end wall 22. The top wall 12 includes a plurality of posts 24 for receiving a socket S. In a preferred embodiment, there are twelve posts, although the number of posts may vary without departing from the scope of the invention. Preferably, the posts 24 are of a diameter less than the underside of the socket and are not intended to frictionally mate with the underside of the socket but function as a guide or visual aid for receiving the socket. Posts 24 are shown in an X shape but may be of various shapes, including polygonal, round, S or the like. The posts 24 are preferably solid in structure. In the embodiment shown in FIG. 1, the posts are of a diameter adjusted for the size of the socket, e.g. a ¼ inch socket or a ⅜ inch socket. The posts height may also be adjusted for a shallow socket or a deep socket as seen, for example, in FIG. 5. Adjacent and under the posts 24 are openings 25 in the top wall 12/bottom wall 14. The openings 25 are to expose a magnet 30 in the top wall to hold the socket to the socket holder. The magnet 30 is preferably flush with the surface of top wall 12. The magnet 30 is preferably rectangular in shape and a neodymium magnet. The strength of the magnet may vary depending primarily on the size of the socket, and to a lesser degree on the needs of attaching the socket holder to a ferrous surface. The magnet strength can be adjusted to the needs of the user but must be sufficiently strong to keep the sockets in place and attach to a ferrous surface.

Referring to FIGS. 3, 3A, 3B and 4, there are retaining members 32 extending downwardly from bottom wall 14 and having legs 34,36 and a base 38. There is an opening 40 in base 38 for exposing magnet 30. Retaining member 32 is adapted to receive and hold magnet 30 by friction fit.

Figure 3:
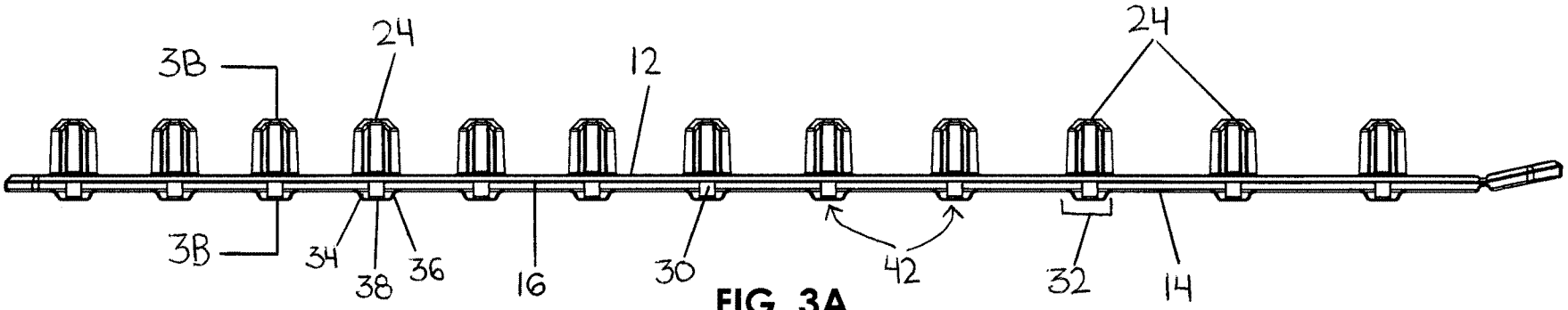
FIG. 3 is a side view of the socket holder of FIG. 1.
Figure 3A:
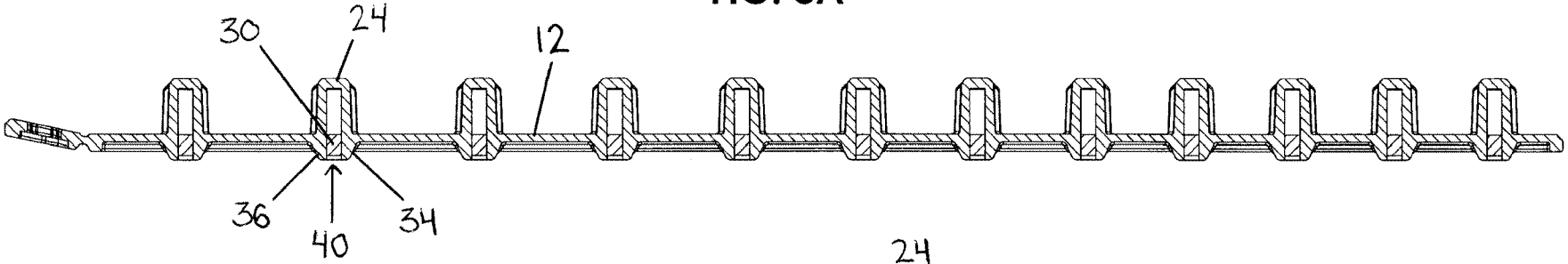
FIG. 3A is a side cross-sectional view taken along line 3A-3A of FIG. 2.
Figure 3B:
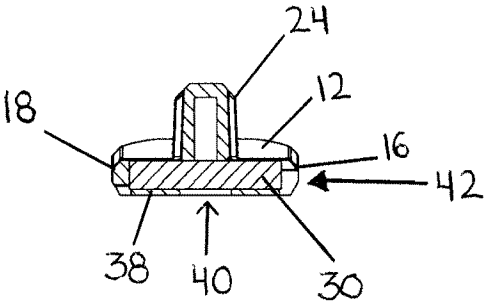
FIG. 3B is a cross-sectional view taken along line 3B-3B of FIG. 3.

Referring to FIGS. 3 and 3A, side wall 16 includes an opening 42 in conjunction with the open area of retaining member 32 for receiving magnet 30 which is held in retaining member 32 by friction fit. Second side wall 18 does not include an opening as in the first side wall and may be closed or include a small opening less than the size of the magnet 30 for retaining magnet 30 in retaining member 32.

Figure 4:
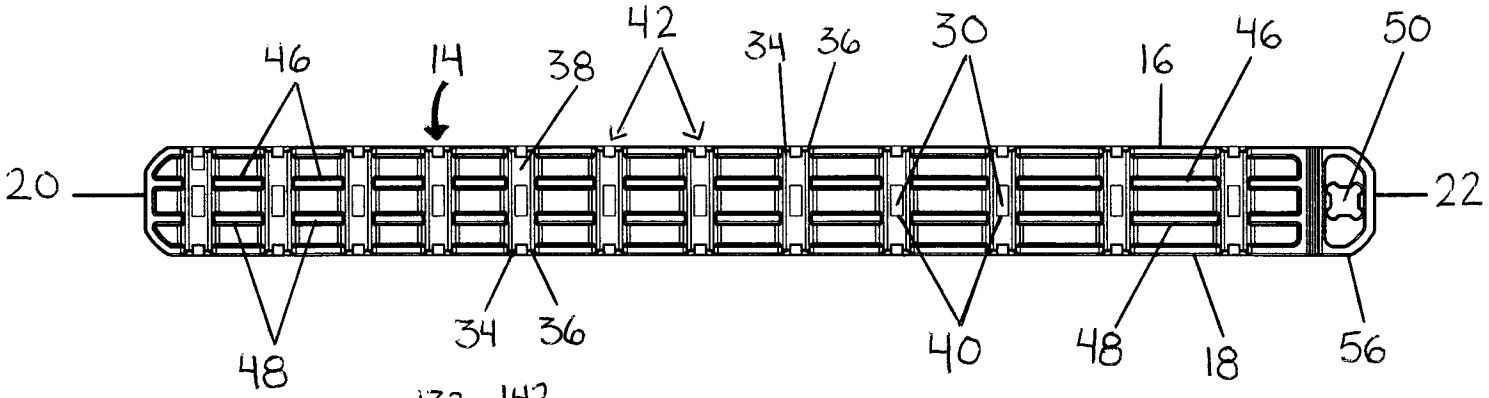
FIG. 4 is a bottom view of the socket holder of FIG. 1.

Referring to FIG. 4, bottom wall 14 includes ribs 46,48, preferably having a height the same as side walls 16 and 18. Ribs 46,48 provide structural support to the socket holder 10 while at the same time providing flexibility to socket holder 10. This structure and the use of the TPR or silicone provides for the flexibility of the socket holder.

The end wall 22 includes an aperture 50 for hanging the socket holder. There is a crease 52 allowing for end wall 56 to mold to have an upward shape for hanging the socket holder.

The strip 12 is preferably molded by injection molding, preferably using TPR or silicone, although similar materials may be used. The magnets 30 are inserted in openings 42. The same mold used to make the flexible strip 12 may also be used to make a non-flexible magnetic socket holder by using a non-flexible material such as ABS (acrylonitrile butadiene styrene). Presently preferred dimensions of the strip for a ¼ inch socket holder are 8 to 10 inches in length; 0.8 to 1 inch in width; 0.48 to 0.52 inches in height; opening 25 is 0.6 to 0.9 inches in length and 0.10 to 0.13 inches in width; opening 42 is 0.11 to 0.13 inches in height and width; posts 24 are 0.24 inches in width and 0.30 in height. Presently preferred dimensions of the strip for a ⅜ inch socket holder are 12 to 14 inches in length; 0.9 to 1.2 inches in width; 0.55 to 0.60 inches in height; opening 25 is 0.6 to 0.9 inches in length and 0.10 to 0.13 inches in width; opening 42 is 0.11 to 0.13 inches in height and width; posts 24 are 0.37 inches in width and 0.30 in height.

Figure 5:
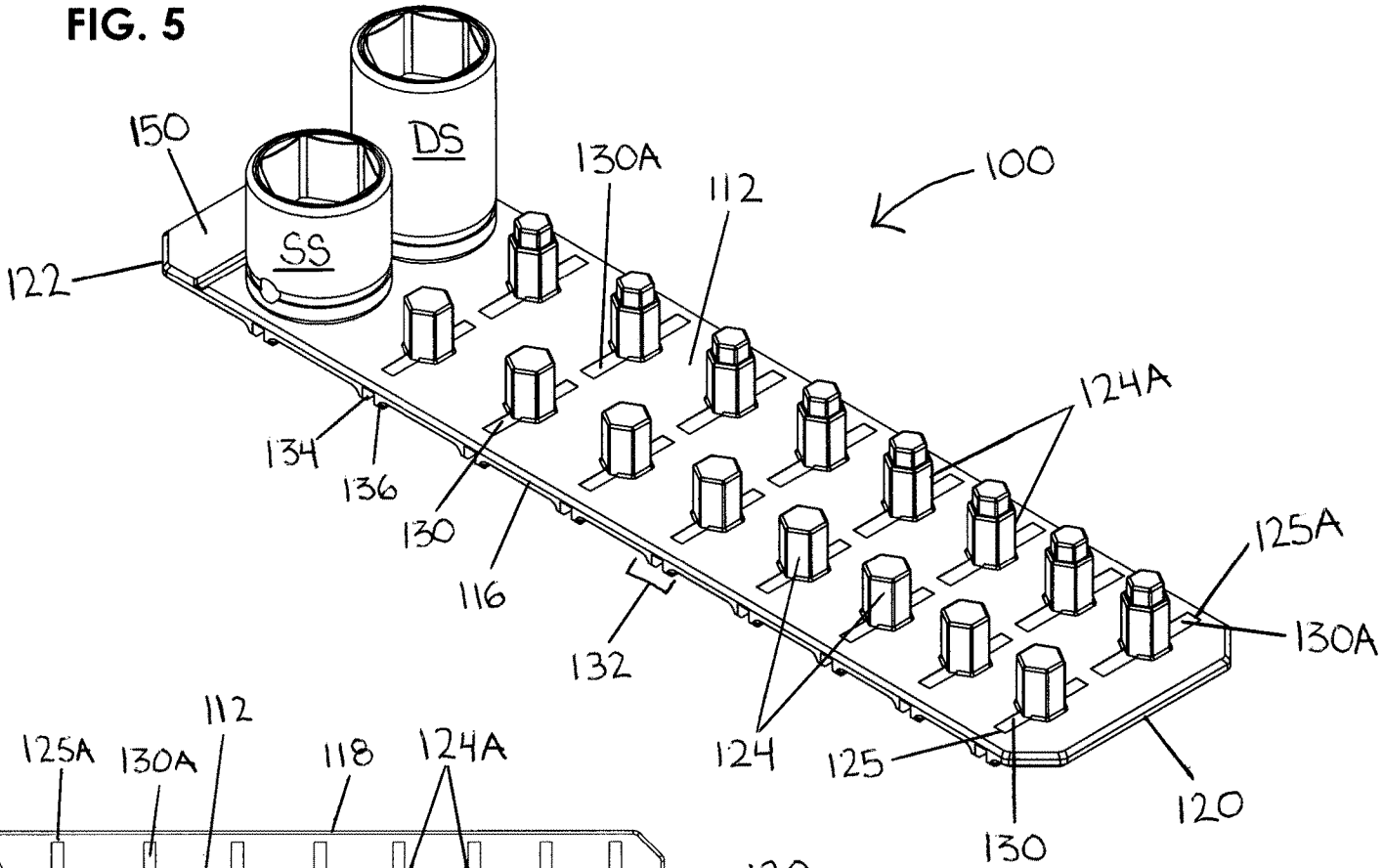
FIG. 5 is a perspective view of a flexible magnetic socket holder having two columns for holding two different size sockets.
Figure 6:
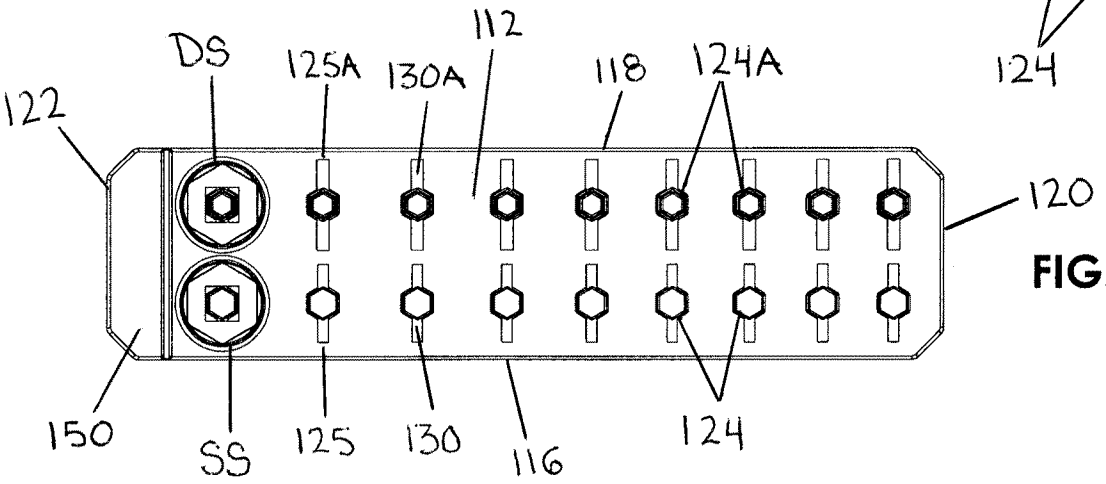
FIG. 6 is a top view of the socket holder of FIG. 5.

Referring to FIGS. 5-8, there is shown a second embodiment of the socket holder having two columns of posts for receiving different size sockets such as a shallow socket SS and a deep socket DS as shown, for example, in FIGS. 5 and 6. In this embodiment, one set of posts are 0.43 inches in height and 0.37 inches in width and the second set of posts are 0.58 inches in height and 0.25 inches in width for holding a shallow socket and deep socket, respectively. The structure of this embodiment is substantially similar to the embodiment in FIGS. 1-4 and is described below.

Referring to FIGS. 5-8, there is shown a socket holder 100 having a top wall 112, bottom wall 114, first side wall 116, second side wall 118, first end wall 120 and second end wall 122. The top wall 112 includes a plurality of posts 124 for receiving a first size socket, a shallow socket, and a plurality of posts 124A for receiving a second size socket, a deep socket. Preferably, the posts 124 and 124A are of a diameter less than the underside of the sockets and are not intended to frictionally mate with the underside of the sockets but function as a guide or visual aid for receiving the sockets. Posts 124,124A may be of various shapes, including polygonal, X, round, S or the like. In the embodiment shown in FIG. 5, there are two columns of nine posts 124,124A and the posts are of a diameter adjusted for the size of the socket. Adjacent the posts 124,124A are openings 125,125A in the top wall 112/bottom wall 114. The openings are to expose magnets 130,130A in the top wall to hold the sockets to the socket holder. The magnets 130,130A are preferably rectangular in shape and a neodymium magnet.

Figure 8:
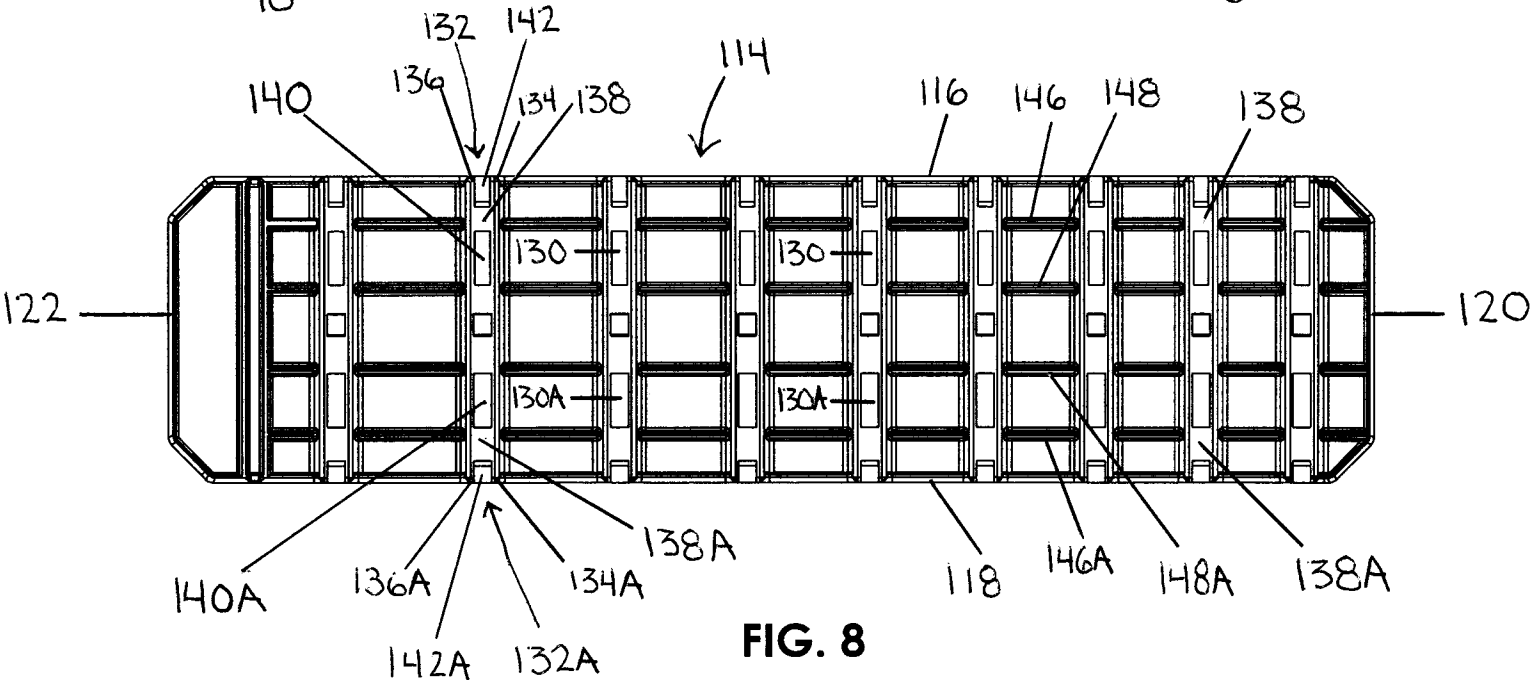
FIG. 8 is a bottom view of the socket holder of FIG. 6.
Figure 7:
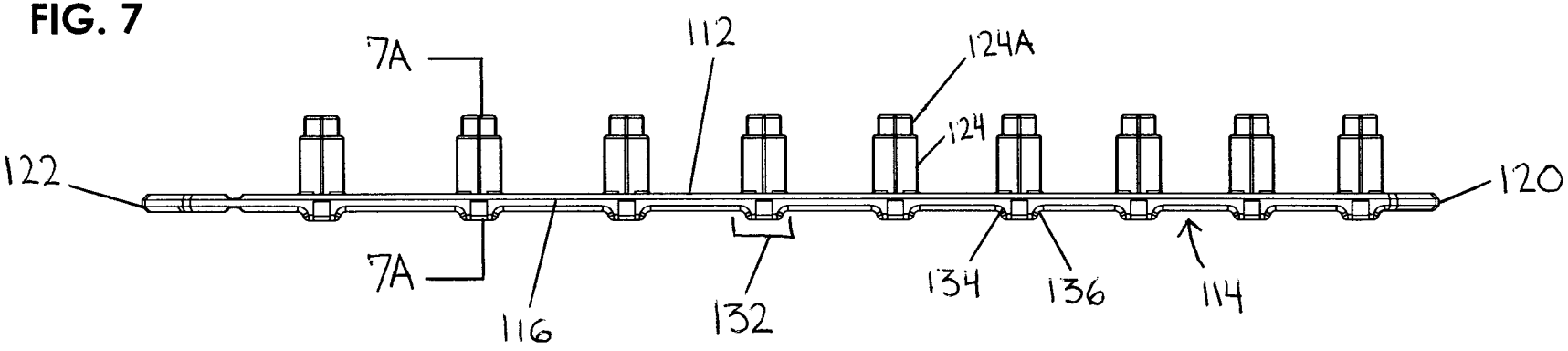
FIG. 7 is a side view of the socket holder of FIG. 5.
Figure 7A:
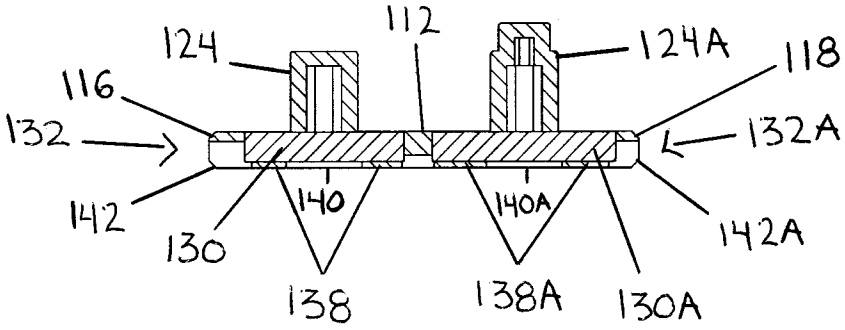
FIG. 7A is a cross-sectional view taken along lines 7A-7A of FIG. 7.

Referring to FIGS. 7, 7A and 8, there are retaining members 132,132A extending downwardly from bottom wall 114 and having legs 134,136,134A,136A and a base 138,138A. There is an opening 140,140A in base 138,138A for exposing magnets 130,130A. Retaining members 132, 132A are adapted to receive and hold magnets 130,130A by friction fit.

Referring to FIGS. 7, 7A and 8, side walls 116,118 include openings 142,142A in conjunction with the open area of retaining member 132,132A for receiving magnets 130, 130A which are held in retaining members 132,132A by friction fit. The openings 142,142A in the first and second side walls are closed in the interior thereof for retaining magnets 130,130A in retaining members 132,132A.

Referring to FIG. 8, bottom wall 114 includes ribs 146, 148,146A,148A preferably having a height the same as side walls 116 and 118 and providing structural support to the socket holder 100 while at the same time also allowing flexibility to socket holder 100.

End wall 122 may have space 150 for a brand name or logo. Like socket holder 10, socket holder 100 may be made by injection molding using TPR or silicone.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. For example, while the preferred embodiments are to have the magnet exposed at least in part in the top wall and the base of the retaining member, the magnet may be covered by a layer of material and the strength of the magnet increased. Such modifications being within the ability of one skilled in the art form a part of the present invention and are embraced by the appended claims.

It is claimed:

1. A flexible magnetic socket holder comprising:

a flexible elongated strip having a top wall, a bottom wall, a first side wall and a second side wall, the top wall having a plurality of posts each post adapted to receive a socket having an opening on sides of the post for exposing a magnet, the bottom wall having a retaining member extending downwardly from the bottom wall under each post and adapted to receive a magnet, the first side wall and the retaining member having an opening adapted to receive a magnet and retain the magnet by friction fit, a magnet is inserted in each of the retaining members through the opening in the first side wall and the retaining member, and— wherein the top wall of the flexible elongated strip is adapted to magnetically hold the sockets at each post and the bottom wall of the flexible elongated strip is adapted to magnetically attach to different shaped metal surfaces.

2. The flexible magnetic socket holder of claim 1 wherein the magnet is rectangular in shape.

3. The flexible magnetic socket holder of claim 1 wherein the shape of the posts are selected from the group of shapes consisting of X shape, S shape, round, polygonal or a combination thereof.

4. The flexible magnetic socket holder of claim 1 wherein the plurality of posts are in a single column.

5. The flexible magnetic socket holder of claim 1 wherein the plurality of posts are in two columns.

6. The flexible magnetic socket holder of claim 1 wherein the retaining member is comprised of a first leg and a second leg joined by a base member.

7. The flexible magnetic socket holder of claim 6 wherein the base member has an opening therein exposing a portion of the magnet.

8. The flexible magnetic socket holder of claim 2 wherein the retaining member is comprised of a first leg and a second leg joined by a base member.

9. The flexible magnetic socket holder of claim 8 wherein the base member has an opening therein exposing a portion of the magnet.

10. The flexible magnetic socket holder of claim 9 wherein the shape of the posts are selected from the group of shapes consisting of X shape, S shape, round, polygonal or a combination thereof.

11. The flexible magnetic socket holder of claim 1 wherein the sockets are selected from the group consisting of ¼ inch sockets and ⅜ inch sockets.

12. The flexible magnetic socket holder of claim 5 wherein a first column of posts is adapted to receive a shallow socket and a second column of posts is adapted to receive a deep socket.

13. The flexible magnetic socket holder of claim 1 wherein the elongated strip is made from a thermoplastic rubber or silicone.

14. The flexible magnetic socket holder of claim 13 wherein the magnet is a neodymium magnet.

15. A flexible magnetic socket holder comprising a flexible elongated strip having a top wall, a bottom wall, a first side wall and a second side wall, —the top wall having a plurality of posts each post adapted to receive a socket, the bottom wall having a retaining member extending downwardly from the bottom wall under each post and adapted to receive a magnet, the first side wall and the retaining member having an opening adapted to receive a magnet and retain the magnet by friction fit, a magnet is inserted in each of the retaining members through the opening in the first side wall and the retaining member, and wherein the top wall of the flexible elongated strip is adapted to magnetically hold the sockets at each post and the bottom wall of the flexible elongated strip is adapted to magnetically attach to different shaped metal surfaces.

16. The flexible magnetic socket holder of claim 15 wherein the magnet is rectangular in shape.

17. The flexible magnetic socket holder of claim 15 wherein the plurality of posts are in a single column.

18. The flexible magnetic socket holder of claim 15 wherein the plurality of posts are in two columns.

19. The flexible magnetic socket holder of claim 15 wherein the retaining member is comprised of a first leg and a second leg joined by a base member.

20. The flexible magnetic socket holder of claim 15 wherein the elongated strip is made from a thermoplastic rubber or silicone.

* * * * *